US007337487B2

(12) United States Patent
Leonardi

(10) Patent No.: US 7,337,487 B2
(45) Date of Patent: Mar. 4, 2008

(54) PRESSURE CLEANER BRUSH FOR WASHING SURFACES

(75) Inventor: Luca Leonardi, Modena (IT)

(73) Assignee: Leophorm S.R.L., Modena (IT)

( * ) Notice: Subject to any disclaimer, the term of this patent is extended or adjusted under 35 U.S.C. 154(b) by 87 days.

(21) Appl. No.: 11/000,963

(22) Filed: Dec. 2, 2004

(65) Prior Publication Data

US 2005/0125921 A1 Jun. 16, 2005

(30) Foreign Application Priority Data

Dec. 3, 2003 (IT) ..... MO2003A0329

(51) Int. Cl.
*A46B 13/04* (2006.01)
*A46B 13/06* (2006.01)

(52) U.S. Cl. ..... 15/29

(58) Field of Classification Search ..... 15/29, 15/24, 22.1; 215/305
See application file for complete search history.

(56) References Cited

U.S. PATENT DOCUMENTS

| | | | | |
|---|---|---|---|---|
| 5,007,127 | A * | 4/1991 | Paolo | 15/29 |
| 5,129,121 | A * | 7/1992 | Gelman | 15/29 |
| 5,619,766 | A * | 4/1997 | Zhadanov et al. | 15/29 |
| 5,911,256 | A * | 6/1999 | Tsai | 15/22.1 |
| 6,253,942 | B1 * | 7/2001 | Elias | 215/305 |
| 2003/0200616 | A1 * | 10/2003 | Chih | 15/29 |

* cited by examiner

*Primary Examiner*—Laura C Guidotti
(74) *Attorney, Agent, or Firm*—Hoffman, Wasson & Gitler, P.C.

(57) ABSTRACT

A pressure cleaner brush for washing surfaces comprising a body inside which a bladed impeller is supported so that it can rotate, the impeller being turned by a jet of water that arrives from a nozzle that is associated with the body, the body being provided with at least one opening from which at least one rotating brush actuated by the impeller protrudes, and at least one tank for containing a detergent fluid, which is associated with the body.

15 Claims, 4 Drawing Sheets

PRESSURE CLEANER BRUSH FOR WASHING SURFACES

The present invention relates to a pressure cleaner brush for washing surfaces.

BACKGROUND OF THE INVENTION

As it is known, when washing surfaces such as for example windows, walls, floors, metal panels and the like, it is necessary to use brushes, cloths or the like together with the application of detergent substances mixed in water.

Moreover, in performing these operations it is known to use pressure cleaner brushes, which comprise a half-shell inside which there is a bladed impeller, which is driven by a jet of water and transmits motion to a rotating brush that protrudes from said half-shell.

Transmission of motion between the impeller and the rotating brush is commonly obtained by direct keying on said shaft or by interposing conventional gear systems, which generally allow to reduce the rotation rate between the driving wheel and the driven wheel.

The jet of water that propels the vanes of the impeller conventionally arrives from a nozzle, which is arranged in the peripheral region of the half-shell and is connected to a rigid tube, which is designed to act as a handle and to the free end of which a generic water supply system can be connected.

In order to facilitate the user in the washing operations, known types of pressure cleaner brush have tablets or the like made of soap or other similar substances, which are introduced in a receptacle provided inside the rigid tube, so that during use they are affected by the incoming water stream.

This solution allows to break down the detergent substances contained in the tablets and to transfer them directly into the washing water that passes through the pressure cleaner brush, allowing the user to perform cleaning operations without resorting separately to the use of external detergents.

These known types of pressure cleaner brush, however, are not free from drawbacks, including the fact that they do not allow to adjust the introduction and dissolving of the detergent substances in the washing water.

In particular, it is noted that these brushes are not suitable to be used, for example, to rinse soap-lathered surfaces, since they do not provide for operation with only water flowing out, unless the tablets contained in them are used up completely.

Moreover, the tablets significantly affect the production and operating costs of conventional pressure cleaner brushes, and this is due to the specifications required for their insertion in the tube of said brushes.

Moreover, there is no possibility to use detergents other than tablets, such as for example commercial ones, which are far cheaper.

Another drawback affects known types of pressure cleaner brush that transmit motion from the impeller to the rotating brush by direct keying; while on the one hand this transmission allows the rotating brush to turn at high speeds, on the other hand it does not allow to give said brush enough torque for efficient operation.

More specifically, the rotating brush is not able to apply a force that is sufficient to overcome even the modest resistance offered by edges or uneven surfaces encountered by said brush during normal cleaning operations, and is disadvantageously subjected to alternating operation with frequent stops.

Transmission of motion by means of the conventional gear systems currently in use, instead, allows to reduce the rotation rate of the rotating brush, transmitting a higher torque to it; at the same time, however, said transmission is significantly bulky.

SUMMARY OF THE INVENTION

The aim of the present invention is to eliminate the above-mentioned drawbacks of the background art, by providing a pressure cleaner brush for washing surfaces that allows the user to adjust, according to the different operating requirements, the amount of detergent substances to be introduced in the water, allowing to avoid unnecessary consumption and also allowing use during the rinsing of the soap-lathered surfaces.

Within this aim, an object of the present invention is to provide a brush that does not require the use of specific and expensive detergents and is therefore particularly competitive from the economic standpoint.

Another object of the present invention is to transmit the motion from the impeller to the rotating brush by reducing the rotation rate and increasing the amount of transferred torque without however compromising the compactness and stability of the moving parts.

Another object of the present invention is to provide a brush that is simple, relatively easy to provide in practice, safe in use, and effective in operation.

This aim and these and other objects that will become better apparent hereinafter are achieved by the present pressure cleaner brush for washing surfaces, which comprises a body inside which a bladed impeller is supported so that it can rotate, said impeller being turned by a jet of water that arrives from a nozzle that is associated with said body,. said body being provided with at least one opening from which at least one rotating brush actuated by said impeller protrudes, characterized in that it comprises at least one tank for containing a detergent fluid, said tank being associated with said body.

BRIEF DESCRIPTION OF THE DRAWINGS

Further characteristics and advantages of the present invention will become better apparent from the following detailed description of a preferred but not exclusive embodiment of a pressure cleaner brush for washing surfaces, illustrated by way of non-limiting example in the accompanying drawings, wherein.

DESCRIPTION OF THE PREFERRED EMBODIMENTS

Figure 1:
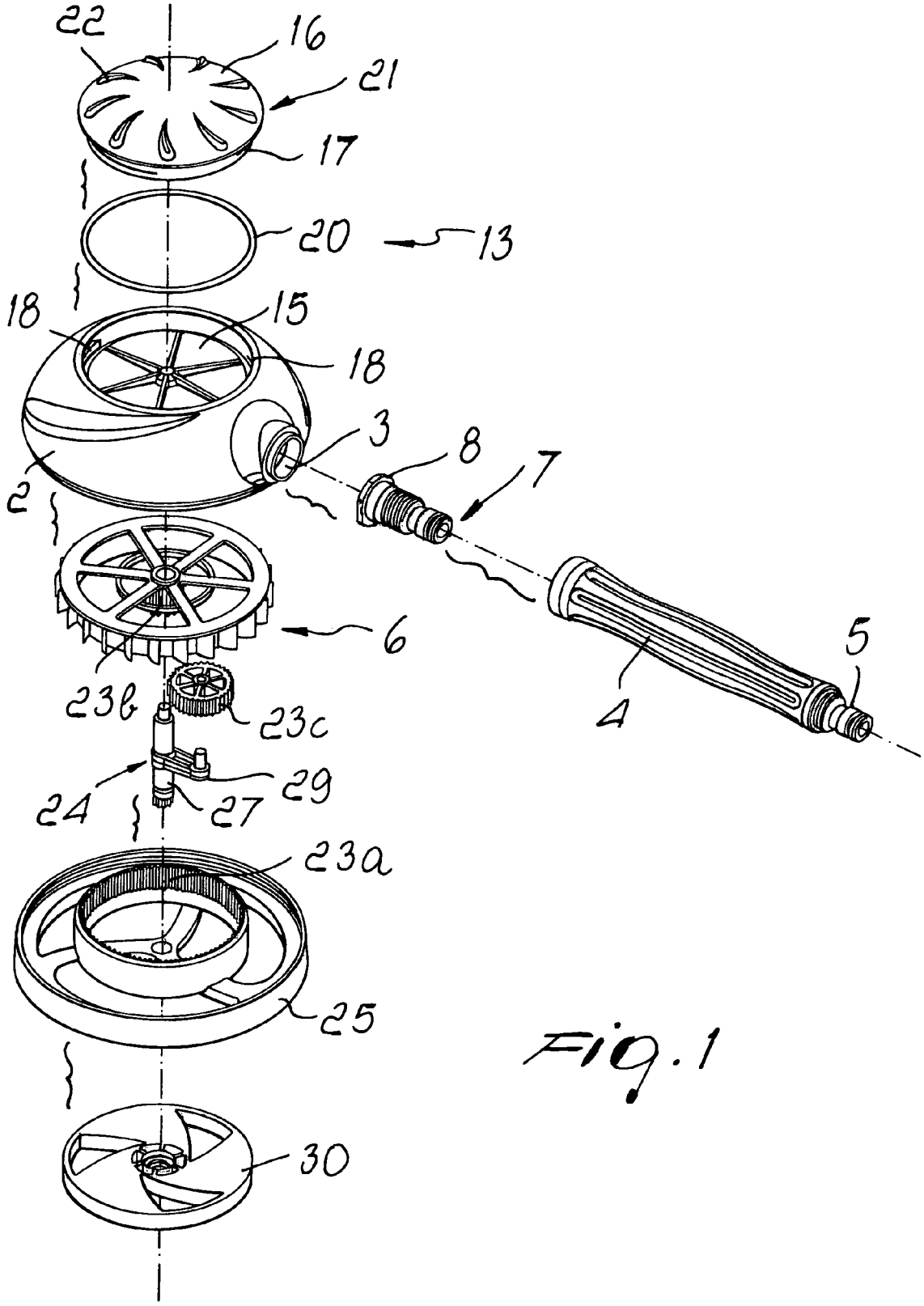
FIG. 1 is an exploded perspective view of the brush according to the invention.
Figure 2:
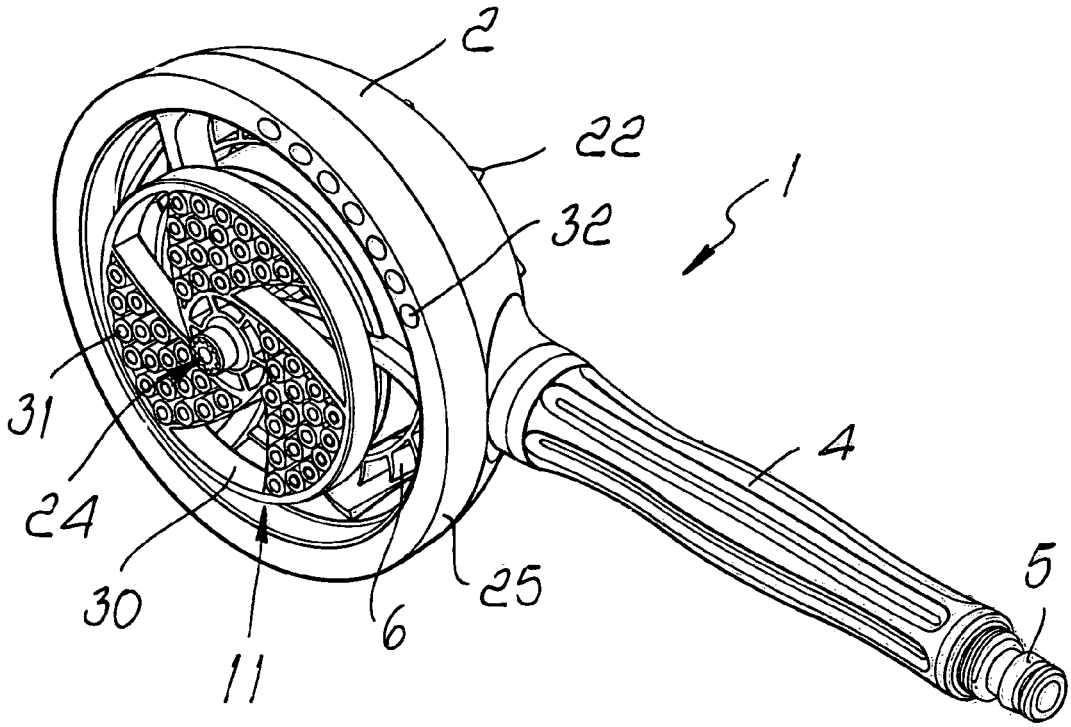
FIG. 2 is a perspective view of the brush according to the invention.
Figure 3:
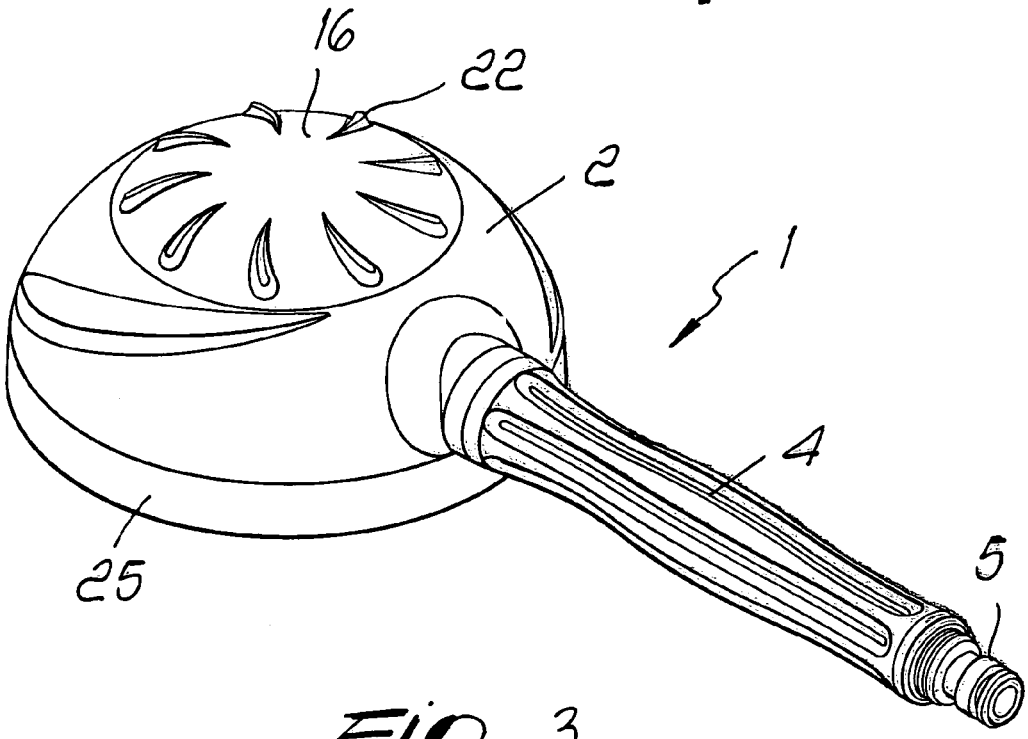
FIG. 3 is a perspective view, from another angle, of the brush according to the invention.
Figure 4:
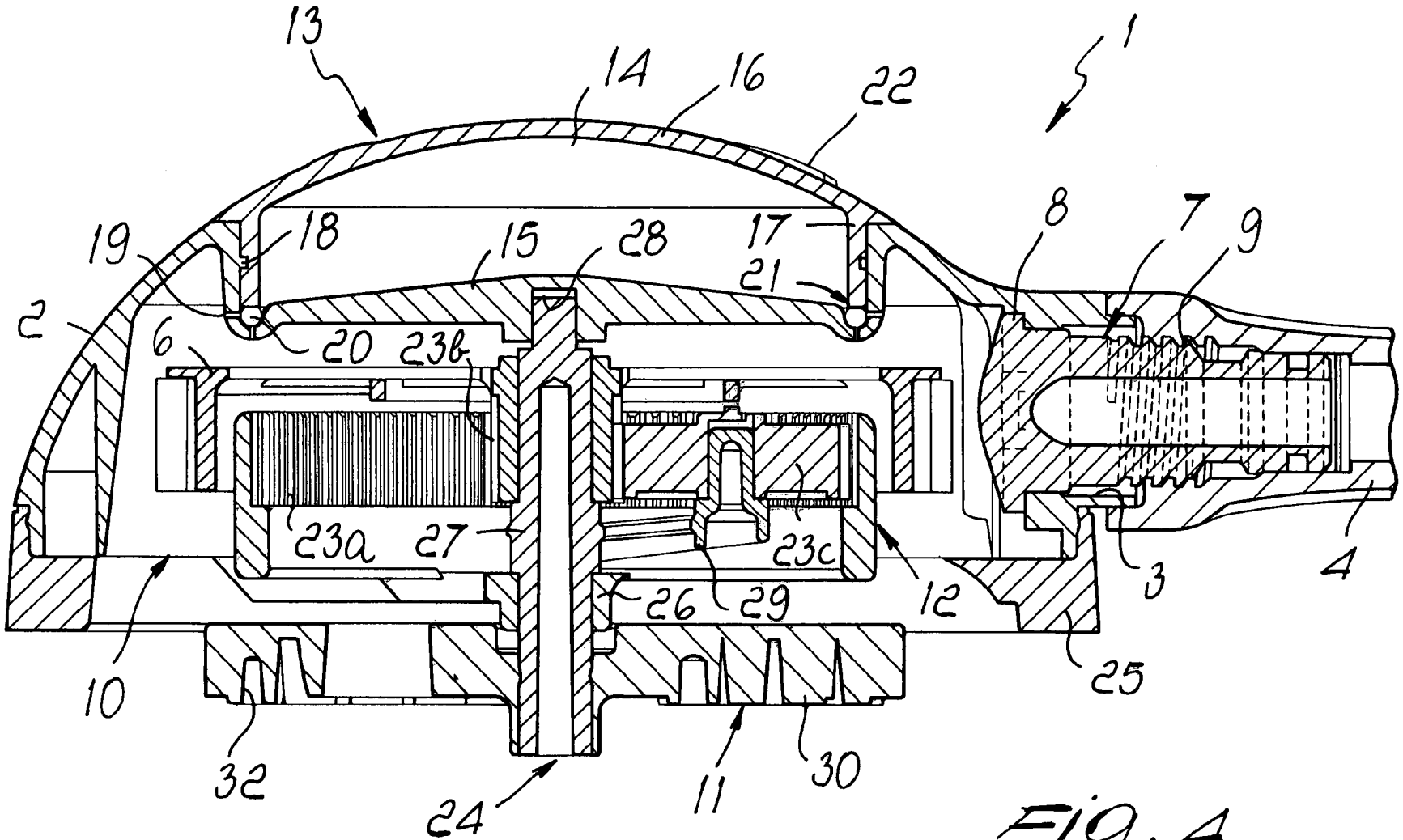
FIG. 4 is a partial sectional view of the brush according to the invention.
Figure 6:
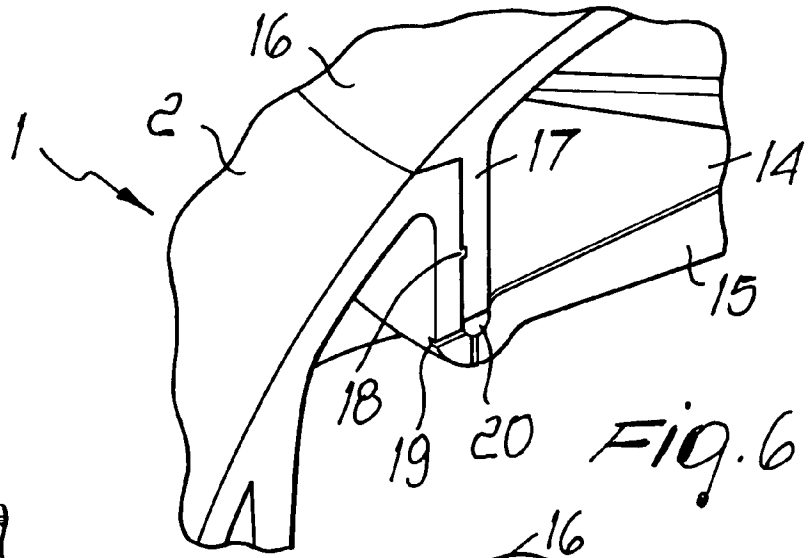
FIG. 6 is a schematic and partial cutout view of the brush according to the invention, in the configuration in which the passages of the tank are fully closed.
Figure 7:
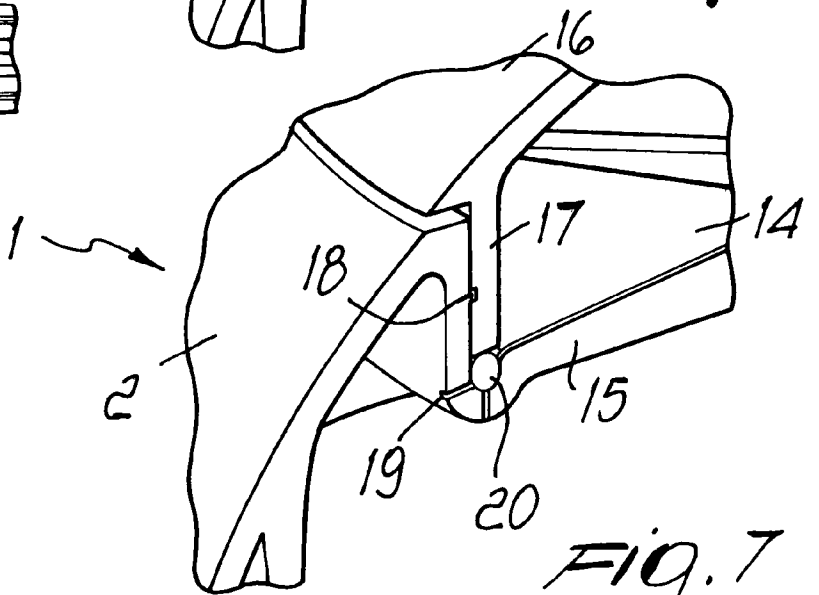
FIG. 7 is a schematic and partial cutout view of the brush according to the invention, in the configuration in which the passages of the tank are partially closed.
Figure 5:
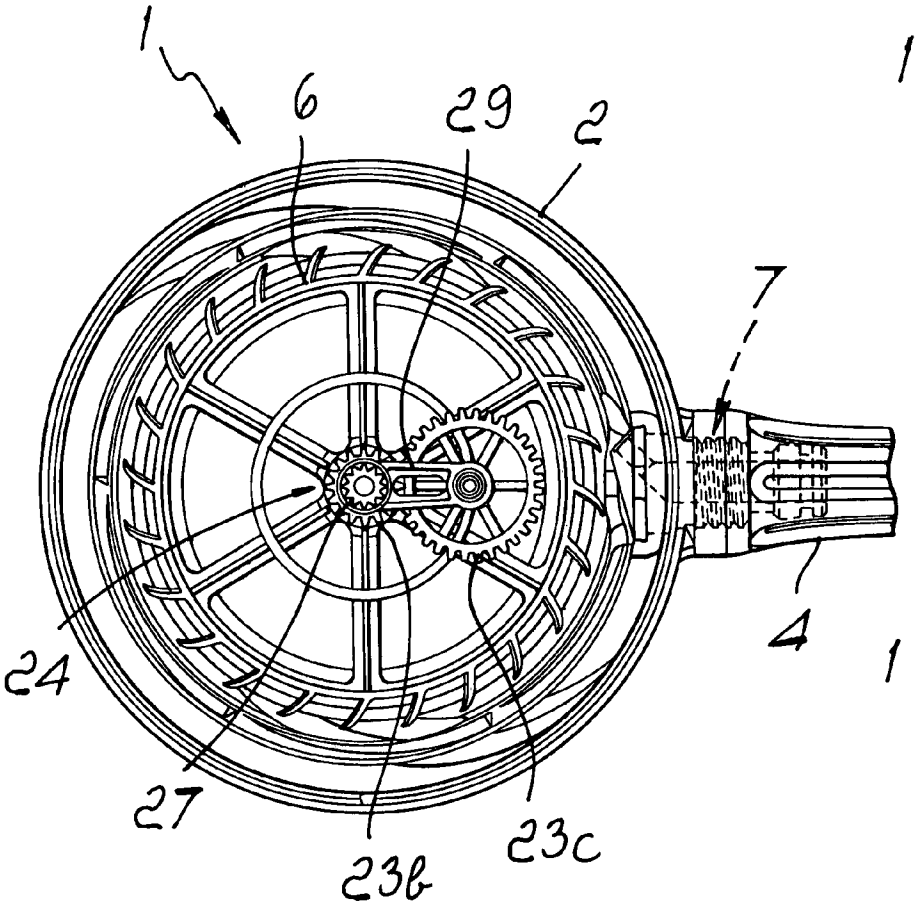
FIG. 5 is a plan view of a portion of the brush according to the invention.

With reference to the figures, the reference numeral 1 designates a pressure cleaner brush for washing surfaces.

The brush 1 comprises a body 2, which is shaped like a half-shell and whose outer wall is crossed by a hole 3, which is connected to a rigid tube 4 that acts as a handle.

The free end of the rigid tube 4 is provided with a connecting element 5, which allows to connect the brush 1 to a water supply system, such as for example the ordinary water mains, a surge tank, a pump or the like.

A vaned or bladed impeller 6 is rotatably supported inside the body 2 and can be turned, during use, by means of a jet of water that arrives from a nozzle 7, which is tangent with respect to said impeller and is associated with the body 2.

Said nozzle is elongated and crosses the hole 3 from end to end, mutually connecting the rigid tube 4 and the body 2; it is in fact provided, at one end, with a head 8 that abuts against the internal surface of the body 2, and is associated, at the other end, with the rigid tube 4 by means of a screw-and-nut connection 9.

The body 2 is provided with a circular opening 10, which is delimited by the mouth of the half-shell formed by said body; a rotating brush 11, actuated by the impeller 6 by interposing a gear system 12, protrudes from said opening.

The brush 1 according to the invention comprises a tank 13 for containing a detergent fluid, which is associated with the body 2 on the opposite side with respect to the opening 10.

The tank 13 is formed by a compartment 14, which is formed inside the body 2, can be accessed from outside, and in particular is delimited inside a recessed wall 15 of the body 2 and can be closed by means of a cover 16.

Said recessed wall is cylindrical, with a circular cross-section and an axis that is perpendicular to the plane of arrangement of the opening 10.

The cover 16 comprises a tubular side wall 17, which also has a circular cross-section, is closed at one end and can be inserted snugly in the recessed wall 15.

Advantageously, the outer side of said side wall is threaded in order to allow the screwing of the cover 16 on three protruding elements 18, which are provided laterally, approximately at 120° to each other, on the recessed wall 15.

The tank 13 is further provided with a plurality of passages 19 for the flow of the detergent fluid from the compartment 14 toward the opening 10, which pass through the recessed wall 15.

The flow of the detergent fluid through said passages occurs by gravity, and in order to control the flow, the brush 1 is provided with means for adjusting the opening and closing of the aperture of said passages.

Conveniently, said adjustment means comprise a flexible sealing body 20, which is formed by an annular gasket, which has the same diameter as the side wall 17 and is accommodated snugly in a circular slot formed on the recessed wall 15: in particular, the passages 19 are formed so as to pass through said recessed wall at said slot.

Moreover, the sealing body 20 is interposed between the recessed wall 15 and a portion 21 of the cover 16, which is formed by the open edge of the side wall 17, so that the screwing of the cover 16 is adapted to compress the sealing body 20, closing at least partially the passages 19.

In order to allow the rotation of the cover 16 with respect to the body 2, the brush 1 is provided with means for gripping said cover, which comprise for example a plurality of wings 22, which are provided so as to protrude on the outer surface of said cover.

Preferably, the wings 22 are distributed radially on said surface, forming a circular succession with a constant pitch, are slightly curved, and are anatomically contoured in order to facilitate the manual grip on the part of the operator.

The gear system 12 that transmits motion from the impeller 6 to the rotating brush 11 is conveniently of the epicyclic type with a gear ratio of less than 1; it in fact comprises a first gear 23*a* with internal teeth, which can be associated rigidly with the body 2, and a second gear 23*b*, which has external teeth and can be associated rigidly and coaxially with the impeller 6; said gears can mesh together by way of the interposition of a third gear 23*c*, which also has external teeth and is supported rotatably by a carrier 24, which can be associated with the rotating brush 11.

In particular, the first gear is associated with an annular support 25, which can be fixed to the body 2 at the edge of the opening 10 and is provided centrally with a hub 26 for supporting the carrier 24.

Said carrier in fact comprises a shaft 27, which is supported rotatably, at one end, in the hub 26 and is inserted, at the other end, in a cylindrical cavity 28 formed in the recessed wall 15.

The portion of the shaft 27 that is adjacent to the recessed wall 15, moreover, supports the second gear 23*b* and the impeller 6, both of which can rotate by sliding on said shaft; the carrier 24 instead comprises, adjacent to the opening 10, a radial arm 29, which is rigidly associated, at one end, with the shaft 27 and rotatably supports, at its free end, the third gear 23*c*, determining its rotation axis.

The carrier 24 lies outside the dome 2; the end portion of the shaft 27 that lies opposite the cavity 28 in fact cantilevers out beyond the hub 26, and the rotating brush 11 is keyed thereon.

In particular, said rotating brush comprises a base 30, on which there are a plurality of seats 31 for accommodating tufts of bristles, not shown in the figure because they are of a known type: in this regard, it is noted that said bristles advantageously can assume any shape and size according to the different requirements of use of the present invention.

Finally, the brush 1 can be provided with a fixed brush, constituted by a series of bristles, also not shown in the figures, which are arranged coaxially around the rotating brush 11 and can be inserted in corresponding slots 32 that can be formed on the annular support 25.

In practice, it has been found that the described invention achieves the intended aim and objects.

The invention thus conceived is susceptible of numerous modifications and variations, all of which are within the scope of the appended claims.

All the details may further be replaced with other technically equivalent elements.

In practice, the materials used, as well as the contingent shapes and dimensions, may be any according to requirements without thereby abandoning the scope of the protection of the appended claims.

The disclosures in Italian Patent Application No. MO2003A000329 from which this application claims priority are incorporated herein by reference.

What is claimed is:

1. A pressure cleaner brush for washing surfaces, comprising:

a body;

a bladed impeller rotatably supported inside said body;

a nozzle connected to said body for providing a jet of water adapted to rotate said impeller;

at least one opening provided at said body;

an epicyclic gear system, said gear system comprising a first gear with internal teeth, which is jointly connectable with said body; a second gear with external teeth, which is jointly connectable and coaxial with respect to said impeller; and at least one third gear with external teeth which is supported by a carrier that is associable with at least one rotating brush, said first and second gears meshing together by interposition of said at least one third gear;

an annular support which is fixable to said body at an edge of said opening, said first gear being associated with said annular support;

said carrier comprising a shaft, which is supported rotatably, at a first end thereof, by a hub of said annular support and, at a second end thereof, in a cavity formed in said body;

said at least one rotating brush protrudes from said opening, said at least one rotating brush being coupled with said impeller by interposition of said epicyclic gear system;

at least one tank for containing a detergent fluid, said tank being associated with said body, wherein said tank is formed by a compartment that is provided in said body, said compartment being accessible from the outside of said body and being provided with a closing cover, wherein said tank is provided with at least one passage defining an aperture adapted to allow flow of said detergent fluid to pass from said compartment toward said opening, and wherein said brush further comprises adjustment means, associated with a rotation of said cover, for adjusting opening and closing of the aperture of said at least one passage, and thereby closing at least partially said passage.

2. The brush of claim 1, wherein said tank is connected to said body on an opposite side thereof with respect to a side of the body where said opening is provided.

3. The brush of claim 1, wherein said compartment is formed inside a recessed wall of said body.

4. The brush of claim 3, wherein said cover comprises a substantially tubular side wall with a circular cross-section, said cover being closed at one end thereof and insertable snugly in said recessed wall.

5. The brush of claim 4, wherein said side wall is threaded on an outer side thereof and so as to be securable by screwing onto at least one protruding element formed on said recessed wall.

6. The brush of claim 5, wherein said passage is formed as an aperture in said recessed wall, said detergent fluid being adapted to pass through said passage by gravity.

7. The brush of claim 5, wherein said adjustment means comprises at least one sealing body, which is flexible and interposed between said recessed wall and at least one portion of said cover, so that screwing of said cover is adapted to compress said sealing body so as to close said passage at least partially.

8. The brush of claim 7, wherein said sealing body is formed by at least one annular gasket with a diameter that is substantially equal to a diameter of said side wall, said gasket being accommodated snugly in a corresponding slot formed in said recessed wall, said at least one portion of the cover being formed by an open edge of said side wall.

9. The brush of claim 3, comprising grip means for gripping said cover.

10. The brush of claim 9, wherein said grip means comprises at least one wing that is formed so as to protrude on an outer surface of said cover.

11. The brush of claim 10, comprising a plurality of said wings, which are distributed substantially radially with a substantially constant pitch.

12. The brush of claim 1, wherein said compartment is formed inside a recessed wall of said body and wherein said shaft supports rotatably said second gear and said impeller adjacent to said recessed wall.

13. The brush to claim 12, wherein said carrier comprises a radial arm associated with said shaft, said third gear being supported at a free end of said radial arm.

14. The brush of claim 1, wherein said rotating brush is keyed to an end portion of said shaft that lies opposite said cavity, said end portion protruding in a cantilevered manner beyond said hub.

15. The brush of claim 1, comprising a fixed brush, which is connected with said annular support and is arranged around said rotating brush, substantially coaxially thereto.

* * * * *